United States Patent [19]

Robinson et al.

[11] Patent Number: 4,480,798

[45] Date of Patent: Nov. 6, 1984

[54] SYSTEM FOR MAINTAINING THE ALIGNMENT OF MANDRELS IN FILAMENT WINDING OPERATIONS

[75] Inventors: Samuel C. Robinson, Clinton; William G. Dodge, Oak Ridge; Roy E. Pollard, Powell, all of Tenn.

[73] Assignee: The United States of America as represented by the United States Department of Energy, Washington, D.C.

[21] Appl. No.: 541,187

[22] Filed: Oct. 12, 1983

[51] Int. Cl.[3] ..... B65H 54/02

[52] U.S. Cl. ..... 242/18 R; 242/18 G; 242/18 DD; 242/36; 242/47; 242/49; 242/66; 242/67.1 R

[58] Field of Search ..... 242/18 R, 18 G, 18 DD, 242/45, 47, 49, 36, 54 R, 65, 66, 67.1, 55, 68, 67.5, 68.7, 78.1, 78.7, 25 R, 1, 75.52

[56] References Cited

U.S. PATENT DOCUMENTS

| | | | |
|---|---|---|---|
| 2,214,333 | 9/1940 | Walsh et al. | 242/45 |
| 2,283,036 | 5/1942 | Bohn | 242/75.52 |
| 2,904,273 | 9/1959 | Turner, Jr. et al. | 242/68.7 X |
| 3,190,576 | 6/1965 | Stone | 242/78.7 X |
| 3,198,449 | 8/1965 | Scher | 242/66 X |
| 3,329,368 | 7/1967 | Mastriani | 242/67.5 X |

*Primary Examiner*—Stanley N. Gilreath

*Attorney, Agent, or Firm*—Earl L. Larcher; Stephen D. Hamel; Michael F. Esposito

[57] ABSTRACT

The present invention is directed to a system for sensing and correcting the alignment of a mandrel being wound with filamentary material with respect to the filamentary material winding mechanism. A positioned reference pin attached to the mandrel is positioned in a beam of collimated light emanating from a laser so as to bisect the light beam and create a shadow therebetween. A pair of photocells are positioned to receive the bisected light beam with the shadow uniformly located between the photocells when the pin is in a selected position. The mandrel is supported in the selected position for the winding of a filamentary material by a position adjustable roller mechanism which is coupled by a screw drive to a reversible motor. Changes in the pin position such as caused by winding growth are sensed by the photocells to provide the displacement of the roller mechanism in the direction necessary to return the mandrel to the selected position.

4 Claims, 2 Drawing Figures

SYSTEM FOR MAINTAINING THE ALIGNMENT OF MANDRELS IN FILAMENT WINDING OPERATIONS

This invention was made as a result of work under Contract W-7405-ENG-26 between Union Carbide Corporation, Nuclear Division and the United States Department of Energy.

BACKGROUND OF THE INVENTION

The present invention relates generally to filament winding operations, and more particularly, to a system for maintaining the mandrel in alignment with the winding machine during the filament winding operations.

Filament-wound structures of various configurations are provided by winding multiple layers of filamentary material about a mandrel. In certain types of filament-winding machines, the mandrel is supported in the necessary position for receiving the filamentary material by rollers or pads. During the winding operation, the mandrel is displaced from its original position with respect to the winding apparatus as a filamentary material is wound about the mandrel due to such conditions such as the build-up of the filamentary material about the mandrel, variations in the winding thickness on various surface portions of the mandrel, or changing the orientation of the mandrel. Inasmuch as the mandrel must be maintained within close tolerances to a selected position with respect to the winding machine for producing a filament winding of accurate dimensions and specified structural characteristics, the mandrel must be often re-aligned during the winding operation to maintain, as close as possible, the original position of the mandrel with respect to the winding machine.

Previously, the re-aligning of the mandrel to the winding machine required that the winding machine be stopped and the position of the filamentary material on the mandrel be determined with a scale. The mandrel position was then adjusted until the filamentary material was capable of being deposited on the mandrel in a desired manner on the mandrel. This technique was slow and depended primarily upon the skill of the operator to re-align the mandrel for the proper reception of the filamentary material. An improvement over the above technique for aligning the mandrel used as a reference on the mandrel and a dial indicator for showing the position of the reference pin with respect to the proper position of the mandrel in the winding machine. The winding machine is periodically stopped and the mandrel was then manually moved to the desired position and the machine re-started. Both of these previous mandrel aligning techniques were fairly inaccurate and highly inefficient since the winding machine must be stopped at various intervals during the winding operation in order to re-align the mandrel for assuring the fabrication of a properly wound filament structure.

SUMMARY OF THE INVENTION

Accordingly, it is the primary aim or objective of the present invention to provide a system for automatically maintaining the mandrel in a selected position during the winding operation so as to obviate or substantially minimize the problems heretofore encountered with respect to maintaining mandrel alignment. This aim or objective is provided by a mandrel alignment system for a filament winding apparatus wherein filamentary material is wound about a mandrel having a position reference pin extending therefrom and which is supported by a position adjustable support means for maintaining the mandrel in position for receiving the filamentary material. The mandrel alignment system comprises light beam transmitting means for projecting a beam of light of a cross section greater than the cross section of the reference pin across the latter for bisecting the beam of light and creating a shadow therebetween indicative of the cross section of the reference pin. Signal generating light detecting means are disposed in the bisected light beam to receive a change in light volume from the light beam when the pin is displaced from a selected position during the winding of the filamentary material about the mandrel and the shadow covers or uncovers portions of the light detecting means. Amplifier means are coupled to the light detecting means for receiving a signal therefrom indicative of the change in the volume of light received by the light detecting means and reversible drive means are coupled to said adjustable support means and responsive to a signal from the amplifier means for returning the pin to the selected position.

The light transmitting means is provided by a laser and the light detecting means comprises a pair of photocells which are positioned to receive essentially uniform levels of light from the beam of light with the shadow of the pin uniformly positioned therebetween when the pin is in the selected position. The amplifier means is a comparator amplifier coupled to each of the photocells and the signal voltage from each of the photocells to the comparator amplifier is at a uniform level when the pin is in the selected position and at different levels from each photocell when the shadow is moved onto one of the photocells due to pin displacement. This differing level of signals to the comparator amplifier provides a directional signal to the drive means for displacing the adjustable support in a selected direction to return the pin to the selected position.

By employing the mandrel positioning mechanism of the present invention, the mandrel is automatically maintained in a selected position during the entire winding operation so as to assure proper filament winding and the attainment of desired physical properties in the wound structure.

Other and further objects of the invention will be obvious upon an understanding of the illustrative embodiment about to be described or will be indicated in the appended claims, and various advantages not referred to herein will occur to one skilled in the art upon employment of the invention in practice.

Figure 1:
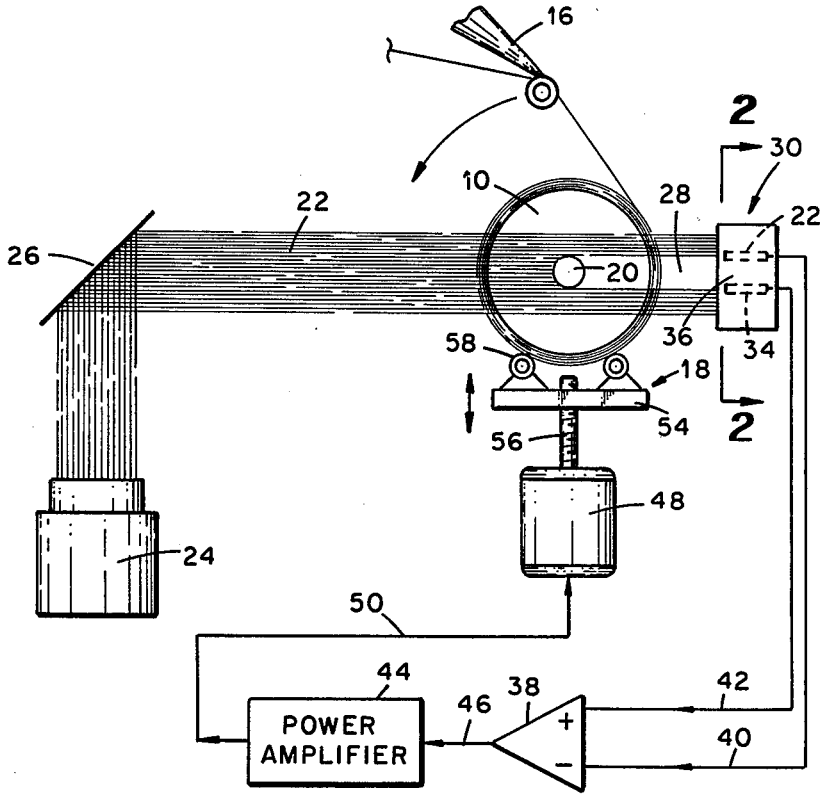
FIG. 1 is a highly schematic view showing a mandrel being wound with filamentary material with the mandrel being positioned by the positioning mechanism of the present invention.

A preferred embodiment of the invention has been chosen for the purpose of illustration and description. The preferred embodiment illustrated is not intended to be exhaustive or to limit the invention to the precise forn disclosed. It is chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

With reference to the accompanying drawing, a mandrel 10 is shown being provided with filamentary material 12 of a suitable type to form a winding 14 about the mandrel 10. The application of the filamentary material 12 onto the mandrel 10 may be provided by an arm 16 affixed to a suitable winding machine (not shown) and which rotates about the mandrel 10 while applying the filamentary material 12 thereon. Alternatively, the mandrel 10 may be rotated relative to a stationary arm on the winding machine to wind the filamentary material upon itself as it is rotated. The mandrel 10 is carried on a support 18 in a preselected position with respect to the position of the arm 16 so as to assure that the filamentary material 12 will be applied in a proper manner about the mandrel 10 as the winding 14 is formed. The position of the mandrel support 18 is adjustable so that as the winding progresses the mandrel 10 may be selectively moved to maintain the desired positional relationship of the mandrel 10 with the arm 16. The mandrel 10 is fitted with a position reference pin or other suitable projection 20 for effecting the alignment of the mandrel 10 during the winding operation since the mandrel 10 will be displaced from its initial position due to winding growth, variations in the winding depth, and various mandrel positions. Each of these changes in the relative position of the mandrel 10 to the arm 16 of the winding machine requires re-adjustment of the mandrel position to assure the formation of a proper winding 14 about the mandrel 10. The pin 20 is of a sufficient length to extend through the winding 14 of the mandrel 10 when the winding is completed.

Figure 2:
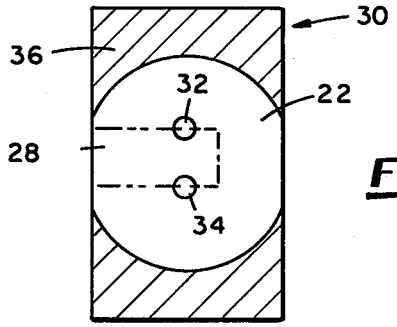
FIG. 2 is a view along lines 2—2 of FIG. 1 showing the position of the photocells in the light beam bisected by a reference pin on the mandrel.

In accordance with the present invention, a collimated light beam 22 from a suitable laser such as a helium-neon laser generally shown at 24, is directed by a mirror system as generally shown at 26 over the pin to bisect the beam 22 into two beams with a shadow 28 therebetween which is indicative of the cross section of the pin 20. The bisected light beam and the shadow are directed toward a signal generating light detecting means as generally shown at 30. This light-detecting means 30 is shown comprising a pair of photocells 32 and 34 mounted on a suitable support 36 so as to uniformly position the photocells with respect to the pin shadow 28 when the pin 20 is in the selected position for the mandrel 10 during the winding operation. In this position as generally shown in FIG. 2 of the drawing, the shadow 28 is uniformly positioned between the photocells 32 and 34 with the shadow 28 partially covering surface portions of each photocell. As the shadow 28 is moved due to pin displacement, one or the other photocells 32 and 34 receives a greater amount or level of light than the other photocell so as to generate a stronger voltage signal than the photocell receiving less light.

A differential amplifier 38 functioning as a comparator amplifier is coupled to the photocells 32 and 34 by leads 40 and 42, respectively, so as to receive the voltage signals generated by the individual photocells due to contact with the light beam 22 emanating from the laser 24. The differential amplifier 38 is preferably suitably biased for assuring that minor differences in the voltages or signal strength from the photocells 32 and 34 do not produce an output signal from the amplifier 38. The differential amplifier 38 is in turn coupled to a suitable power amplifier 44 by lead 46 for generating an output voltage of sufficient magnitude for operating a reversible motor 48 coupled to the power amplifier 44 by lead 50. The reversible motor 48 is coupled to the base 54 of the mandrel support 18 by a screw shaft 56 which is threadedly received in the base 54 so that rotation of the shaft 56 moves the base 54 up or down depending upon the direction of its rotation. As shown, the base 54 provides supports for the rollers 58 which support the mandrel 10 in a selected position for the winding operation.

In a typical operation of the subject invention, a mandrel 10 having a reference pin 20 attached thereto is aligned on the rollers 58 of the mandrel support 18 in a preselected position for receiving the filament material 12 from the winding arm 16. As the filamentary material 12 is wound on the mandrel 10 in a selected pattern, the mandrel 10 and the reference pin 20 are raised on the support rollers 56 as the thickness of the winding 14 increases. As the mandrel 10 rises, the shadow 28 from the pin 20 is moved to cover a greater surface portion of photocell 32 while exposing a greater surface area of photocell 34. Since photoccell 34 is now exposed to more light or a greater level of light than the photocell 32, a signal from photocell 34 is conveyed to the comparator amplifier 38 to generate a output signal to the power amplifier 44 for driving the motor 48 and rotating the screw shaft 56 for lowering the mandrel support 18 until the shadow 28 is returned to its initial position where equal amounts of light are received by both photocells. When this position of the pin 20 is attained the voltage output from the photocells is the same and the signal output from the comparator amplifier is terminated to stop the motor 48. This repositioning of the mandrel 10 is continuous during the winding operation so as to constantly maintain the mandrel 10 in the preferred or selected position.

In addition to the changes in the position of the mandrel 10 due to winding growth other changes in the position of the mandrel 10 on the rollers 58 occur when there are variations in the depth of the winding. In these instances the pin 20 may be raised or lowered so as to move the shadow 28 across the photocells in either direction. In either case when the shadow 28 is displaced so as to expose one of the photocells to a greater amount of light while decreasing the amount of light received by the other photocell, the signal to the comparator amplifier 38 will be such that the motor 48 will be rotated in the proper direction to raise or lower the mandrel support 18 for maintaining the selected position of the mandrel 10 in the winding apparatus.

While the subject system is shown using two photocells if winding growth is the only condition being sensed for the purpose of mandrel alignment a single photocell may be utilized. In this simpler embodiment, the photocell would be positioned in the shadow 28 so that as the growth of the winding occurs, the photocell would be exposed to the light beam 22 so as to generate a signal voltage directly to an amplifier. This, in turn, would operate the motor 48 in a single direction to lower the support structure 18 and return the mandrel 10 to its selected position.

It will be seen that the present invention provides a system for constantly monitoring and automatically maintaining the mandrel in a selected position during the winding operation. By employing the present invention, the dimensional accuracy of the filamentary winding and the efficiency of the winding operation are substantially increased over previous practices.

What is claimed is:

1. A mandrel alignment system for a filament winding apparatus wherein filamentary material is wound about a mandrel having a position reference pin extending therefrom and supported by adjustable support means for maintaining the mandrel in a selected position for receiving the filamentary material, comprising;

light beam transmitting means for projecting a beam of light of a cross section greater than the cross section of the reference pin across the latter for bisecting the light beam and creating a shadow therebetween indicative of the cross section of the reference pin;

signal generating light-detecting means disposed to receive a change in light volume from said light beam when said pin is displaced from a selected position during the winding of the filamentary material about the mandrel;

amplifier means coupled to said light detecting means for receiving a voltage signal therefrom indicative of the change in the volume of light received by said light detecting means, and drive means coupled to said adjustable support means and responsive to an output signal from said amplifier means for returning said pin to said selected position.

2. A mandrel alignment system as claimed in claim 1, wherein the light beam transmitting means is a laser for providing a collimated beam of light, and wherein said signal generating light detecting means comprises a photocell.

3. A mandrel alignment system as claimed in claim 2, wherein a pair of photocells are positioned to receive essentially uniform levels of light from said beam of light and uniformly receive said shadow therebetween when said pin is in said selected position, wherein said amplifier means comprises a comparator amplifier coupled to each of said photocells for receiving from each of said photocells a signal indicative of the level of light received by each photocell, and wherein a signal to the comparator amplifier from each photocell is at a uniform level when said pin in said selected position and at different levels when said shadow is moved onto one of the photocells and away from the other photocell due to pin displacement so as to provide a directional signal from said comparator amplifier to said drive means for displacing the adjustable support means in a selected direction for returning the pin to the selected position.

4. The mandrel alignment system as claimed in claim 3, wherein said adjustable support means comprises roller means in contact with the winding of filamentary material on said mandrel and screw means coupled to the roller means for displacing the latter upon rotation of the screw means, and wherein said drive means comprises a reversible motor coupled to said screw means for effecting the rotation thereof in a particular direction depending upon the directional signal from said comparator amplifier.

* * * * *